US009174763B2

(12) United States Patent
Smalley et al.

(10) Patent No.: US 9,174,763 B2
(45) **Date of Patent: *Nov. 3, 2015**

(54) CARTON WITH INSERT

(71) Applicant: Graphic Packaging International, Inc., Atlanta, GA (US)

(72) Inventors: Brian Smalley, Bristol (GB); Emili Requena, Igualada (ES); Ana Gonzalez, Igualada (ES)

(73) Assignee: Graphic Packaging International, Inc., Atlanta, GA (US)

( * ) Notice: Subject to any disclaimer, the term of this patent is extended or adjusted under 35 U.S.C. 154(b) by 232 days.

This patent is subject to a terminal disclaimer.

(21) Appl. No.: 13/922,270

(22) Filed: Jun. 20, 2013

(65) Prior Publication Data

US 2013/0277260 A1 Oct. 24, 2013

Related U.S. Application Data

(63) Continuation of application No. 13/719,662, filed on Dec. 19, 2012, now Pat. No. 8,496,109, which is a continuation of application No. PCT/US2011/042483, filed on Jun. 30, 2011.

(60) Provisional application No. 61/398,956, filed on Jul. 2, 2010.

(51) Int. Cl.

| | |
|---|---|
| ***B65D 5/42*** | (2006.01) |
| ***B65D 71/00*** | (2006.01) |
| ***B65D 5/44*** | (2006.01) |
| ***B65D 5/02*** | (2006.01) |
| ***B65D 5/468*** | (2006.01) |
| ***B31B 1/26*** | (2006.01) |
| ***B65D 5/46*** | (2006.01) |
| ***B31B 1/90*** | (2006.01) |
| ***B65D 5/66*** | (2006.01) |

(52) U.S. Cl.

CPC . *B65D 5/445* (2013.01); *B31B 1/26* (2013.01); *B31B 1/90* (2013.01); *B65D 5/02* (2013.01); *B65D 5/0227* (2013.01); *B65D 5/4608* (2013.01); *B65D 5/46072* (2013.01); *B65D 5/6632* (2013.01)

(58) Field of Classification Search

CPC combination set(s) only.
See application file for complete search history.

(56) References Cited

U.S. PATENT DOCUMENTS

| | | | |
|---|---|---|---|
| 5,224,919 | A | 7/1993 | Walsh |
| 6,170,741 | B1 | 1/2001 | Skolik et al. |

(Continued)

OTHER PUBLICATIONS

International Search Report and Written Opinion for PCT/US2011/042483 dated Feb. 21, 2012.

(Continued)

*Primary Examiner* — Jacob K Ackun
(74) *Attorney, Agent, or Firm* — Womble Carlyle Sandridge & Rice, LLP

(57) ABSTRACT

A carton for holding a plurality of containers. The carton comprises a plurality of panels that extends at least partially around an interior of the carton. At least two end flaps can cooperate to at least partially form a closed end of the carton. A reinforcing insert comprises a central panel and at least one reinforcing end flap. The central panel can be at least partially disposed in the interior of the carton, and the at least one reinforcing end flap can comprise a base portion and a distal portion foldably connected to the base portion. The base portion extends in an oblique direction from the central panel toward the closed end of the carton.

33 Claims, 6 Drawing Sheets

(56) References Cited

U.S. PATENT DOCUMENTS

| | | | | |
|---|---|---|---|---|
| 6,968,992 | B2 | 11/2005 | Schuster | |
| 8,459,534 | B2 * | 6/2013 | Bradford | 229/117.13 |
| 2005/0087592 | A1 * | 4/2005 | Schuster | 229/117.16 |
| 2007/0007325 | A1 * | 1/2007 | Suzuki et al. | 229/117.16 |
| 2007/0108261 | A1 | 5/2007 | Schuster | |
| 2007/0131748 | A1 | 6/2007 | Brand | |
| 2008/0023535 | A1 * | 1/2008 | Holley, Jr. | 229/244 |
| 2008/0128479 | A1 | 6/2008 | Bates et al. | |
| 2010/0044420 | A1 | 2/2010 | Brand et al. | |
| 2011/0011924 | A1 | 1/2011 | Spivey et al. | |
| 2011/0049228 | A1 | 3/2011 | Brand | |
| 2012/0067755 | A1 | 3/2012 | Spivey, Sr. | |
| 2012/0091021 | A1 | 4/2012 | Smalley | |
| 2014/0332428 | A1 * | 11/2014 | Holley, Jr. | 206/433 |

OTHER PUBLICATIONS

Notice of Allowance and Fee(s) Due for U.S. Appl. No. 13/719,662 dated Apr. 11, 2011.

Part B—Fee(s) Transmittal for U.S. Appl. No. 13/719,662 dated Jun. 20, 2013.

* cited by examiner

CARTON WITH INSERT

CROSS-REFERENCE TO RELATED APPLICATION

This application is a continuation application of U.S. patent application Ser. No. 13/719,662, filed Dec. 19, 2012, which is a continuation application of PCT/US2011/042483, filed Jun. 30, 2011, which application claims the benefit of U.S. Provisional Patent Application No. 61/398,956, filed Jul. 2, 2010.

INCORPORATION BY REFERENCE

The disclosures of U.S. patent application Ser. No. 13/719,662, which was filed on Dec. 19, 2012, PCT/US2011/042483, which was filed on Jun. 30, 2011, and U.S. Provisional Patent Application No. 61/398,956, which was filed on Jul. 2, 2010, are hereby incorporated by reference for all purposes as if presented herein in its entirety.

BACKGROUND OF THE DISCLOSURE

The present disclosure generally relates to cartons for holding beverage containers or other types of articles. More specifically, the present disclosure relates to cartons having a reinforcing insert.

SUMMARY OF THE DISCLOSURE

In general, one aspect of the disclosure is directed to a carton for holding a plurality of containers. The carton comprises a plurality of panels that extends at least partially around an interior of the carton. The plurality of panels can comprise a top panel, a bottom panel, a first side panel, and a second side panel. At least two end flaps are respectively foldably attached to respective panels of the plurality of panels. The at least two end flaps can be overlapped with respect to one another to thereby at least partially form a closed end of the carton. A reinforcing insert comprises a central panel and at least one reinforcing end flap. The central panel can be at least partially disposed in the interior of the carton, and the at least one reinforcing end flap can comprise a base portion and a distal portion foldably connected to the base portion. The base portion extends in an oblique direction from the central panel toward the closed end of the carton, at least a portion of the distal portion is positioned outwardly of at least one end flap of the at least two end flaps, and the distal portion comprises at least one tab extending toward at least one of the first side panel and the second side panel.

In another aspect, the disclosure is generally directed to a combination of a carton blank and an insert blank for forming a carton having container-restraining features for restraining movement of containers in the carton. The carton blank comprises a plurality of panels comprising a top panel, a first side panel, a bottom panel, and a second side panel. The carton blank can further comprise at least two end flaps respectively foldably attached to respective panels of the plurality of panels. The at least two end flaps are for being overlapped with respect to one another to thereby at least partially close an end of the carton formed from the carton blank and the insert blank. The insert blank comprises a central panel for being at least partially disposed in the interior of the carton formed from the carton blank and the insert blank. The insert blank can further comprise at least one reinforcing end flap comprising a base portion and a distal portion foldably connected to the base portion. The base portion is for being positioned to extend in an oblique direction from the central panel toward the closed end of the carton when the carton is formed from the carton blank and the insert blank. At least a portion of the distal portion is for being positioned outwardly of at least one end flap of the at least two end flaps when the carton is formed from the carton blank and the insert blank. The distal portion comprises at least one tab that is for being positioned to extend toward at least one of the first side panel and the second side panel.

In another aspect, the disclosure is generally directed to a method of forming a carton. The method comprises obtaining a carton blank comprising a plurality of panels comprising a top panel, a first side panel, a bottom panel, and a second side panel, and at least two end flaps respectively foldably attached to respective panels of the plurality of panels. The method can further comprise obtaining a reinforcing insert comprising a central panel and at least one reinforcing end flap. The at least one reinforcing end flap comprises a base portion and a distal portion foldably connected to the base portion. The distal portion can comprise at least one tab. The method further comprises positioning the reinforcing insert relative to the carton blank so that the central panel overlaps at least a portion of the top panel, and forming an interior of the carton at least partially defined by the plurality of panels with the central panel disposed at least partially within the interior of the carton. The forming the interior of the carton can comprise forming an open-ended sleeve. The method further comprising positioning the base portion of the at least one reinforcing end flap to extend in an oblique direction from the central panel toward an end of the open-ended sleeve, and positioning the at least two end flaps and the distal portion of the at least one reinforcing end flap to at least partially close an end of the open-ended sleeve. At least a portion of the distal portion can be positioned outwardly of at least one end flap of the at least two end flaps, and the at least one tab of the distal portion can extend toward at least one of the first side panel and the second side panel.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

Figure 1:
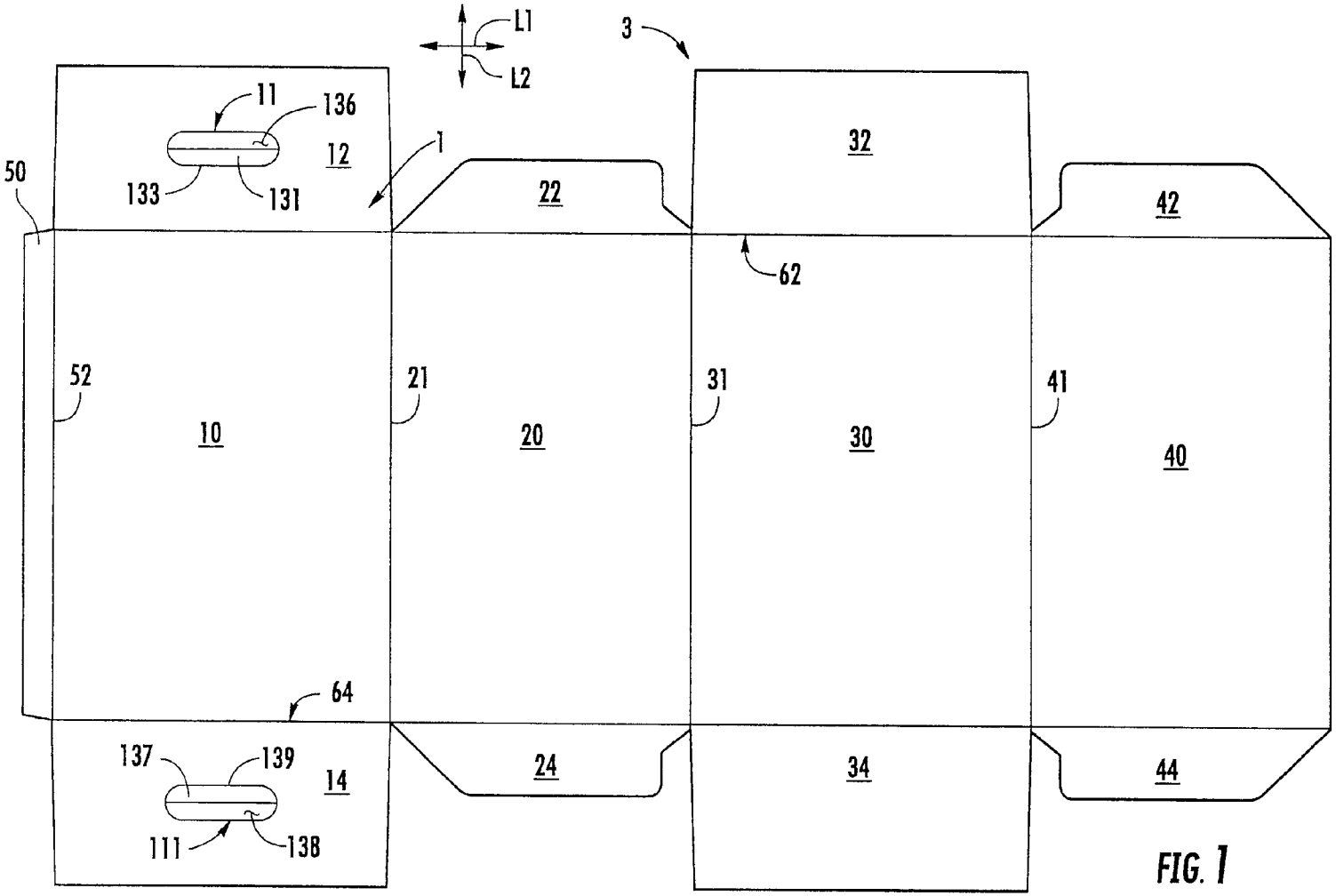
FIG. 1 is an exterior plan view of a carton blank for forming a carton according to an exemplary embodiment of the disclosure.
Figure 4:
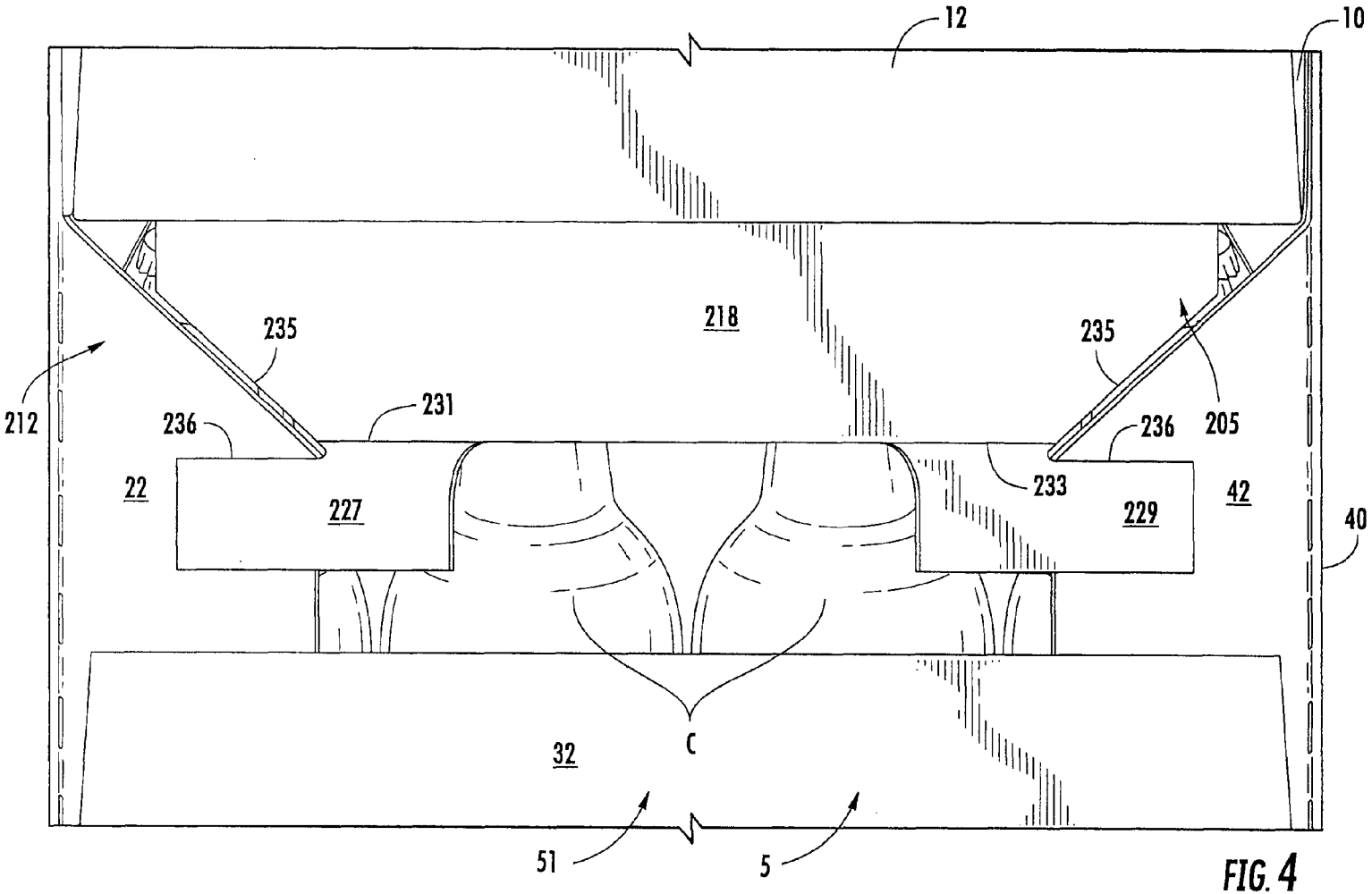
FIG. 4 is a view of the end of the partially erected carton according to the exemplary embodiment of the disclosure.

FIG. 1 is a plan view of the exterior side 1 of a blank, generally indicated at 3, used to form a carton 5 (FIG. 7) according to the exemplary embodiment of the disclosure. The carton 5 can be used to house a plurality of articles such as containers C (FIG. 4). In the illustrated embodiment, the carton 5 is sized to house twenty-four containers C in a single layer in a 4×6 arrangement, but it is understood that the carton 5 may be sized and shaped to hold containers of a different or same quantity in more than one layer and/or in different row/column arrangements (e.g., 1×6, 3×6, 2×6×2, 3×4, 3×5, 4×5, 2×9, 2×6, 3×4, etc.). In the illustrated embodiment, the carton 5 includes a first handle, generally indicated at 11 for grasping and carrying the carton at a first end 51 of the carton (FIGS. 5 and 7), and a second handle, generally indicated at 111, for grasping and carrying the carton at a second end 53 of the carton. As will be discussed below in more detail, the handles 11, 111 are formed from various features in the blank 3.

The carton blank 3 has a longitudinal axis L1 and a lateral axis L2. In the illustrated embodiment, the blank 3 comprises a top panel 10 foldably connected to a first side panel 20 at a first lateral fold line 21. A bottom panel 30 is foldably connected to the first side panel 20 at a second lateral fold line 31. A second side panel 40 is foldably connected to the bottom panel 30 at a third lateral fold line 41. In the illustrated embodiment, the blank 3 includes an attachment flap 50 foldably connected to the top panel 10 at a fourth lateral fold line 52.

The top panel 10 is foldably connected to a first top end flap 12 and a second top end flap 14. The first side panel 20 is foldably connected to a first side end flap 22 and a second side end flap 24. The bottom panel 30 is foldably connected to a first bottom end flap 32 and a second bottom end flap 34. The second side panel 40 is foldably connected to a first side end flap 42 and a second side end flap 44. When the carton 5 is erected, the top and bottom end flaps 12 and 32 and side end flaps 22 and 42 close a first end 51 of the carton, and the top and bottom end flaps 14 and 34 and side end flaps 24 and 44 close a second end 53 of the carton. In accordance with an alternative embodiment of the present disclosure, different flap arrangements can be used for at least partially closing the ends 51, 53 of the carton 5.

The top and bottom end flaps 12, 32 and side end flaps 22, 42 extend along a first marginal area of the blank 3, and are foldably connected at a first longitudinal fold line 62 that extends along the length of the blank. The top and bottom end flaps 14, 34 and side end flaps 24, 44 extend along a second marginal area of the blank 3, and are foldably connected at a second longitudinal fold line 64 that also extends along the length of the blank. The longitudinal fold lines 62, 64 may be, for example, substantially straight, or offset at one or more locations to account for blank thickness or for other factors.

As shown in FIG. 1, the features that form the first handle 11 of the carton 5 include an elongate handle flap 131 formed in the top end flap 12 and foldably attached to the top end flap at a handle fold line 133. In the illustrated embodiment, the features of handle 11 include an elongate opening 136 adjacent the handle flap 131. In the illustrated embodiment, the second handle 111 is formed from features that are substantially similar to the features that form the first handle 11. For example, the second handle 111 includes an elongate handle flap 137 foldably connected to the top end flap 14 at a handle fold line 139. An elongate opening 138 in the top end flap 14 is adjacent the handle flap 137. The second handle 111 could have different features than the first handle without departing from the disclosure. Further, the second handle 111 can be omitted without departing from the disclosure.

Figure 2:
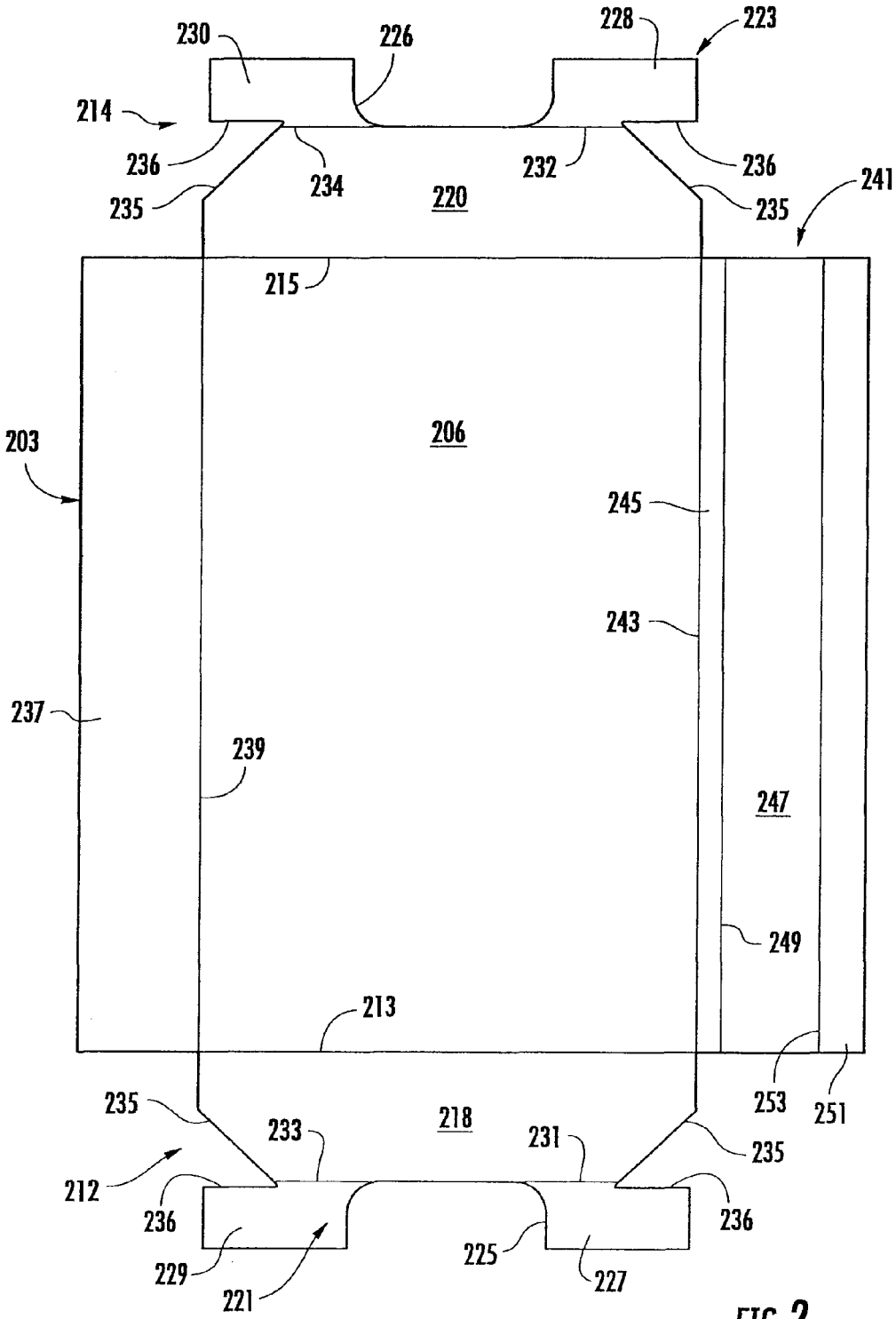
FIG. 2 is an exterior plan view of an insert blank for forming an insert according to the exemplary embodiment of the disclosure.

FIG. 2 illustrates an insert blank 203 used to form a reinforcing insert 205 (FIGS. 4 and 5) for use in the carton 5. In the illustrated embodiment, the insert blank 203 includes a central panel 206 and two reinforcing end flaps 212, 214 respectively foldably connected to the central panel 206 at opposite ends of the central panel. A first fold line 213 connects the first reinforcing end flap 212 at the first end of the insert blank 203. A second fold line 215 connects the second reinforcing end flap 214 at the second end of the insert blank 203. The reinforcing end flap 212 includes a base portion 218 at a respective end edge of the central panel 206 and a distal portion 221 foldably connected to the base portion. The distal portion 221 includes a U-shaped notch 225 and two tabs 227, 229 each extending laterally outward from the U-shaped notch. The tabs 227, 229 are foldably connected to the base portion 218 at respective fold lines 231, 233 extending laterally outward from the U-shaped notch. The second reinforcing end flap 214 is similarly shaped as the first reinforcing end flap 212 having a base portion 220, a distal portion 223 with a U-shaped notch 226, tabs 228, 230, and fold lines 232, 234.

As shown in FIG. 2, the reinforcing end flap 212 can include two oblique edges 235 defining a portion of the base portion 218 and extending into the respective tabs 227, 229. In the illustrated embodiment, the oblique edges 235 intersect the respective fold lines 231, 233, and a lateral edge 236 of each respective tab 227, 229 extends from an end of each oblique edge 235. The reinforcing end flap 214 also can include two oblique edges 235 defining a portion of the base portion 220 and extending to a lateral edge 236 of the respective tabs 228, 230. Alternatively the reinforcing end flaps 212, 214 can be otherwise shaped, configured, arranged, and/or disposed without departing from this disclosure.

In the illustrated embodiment, the insert blank 203 includes a first side flap 237 foldably connected to the central panel 206 at a longitudinal fold line 239 and a second side flap 241 foldably connected to the central panel at a longitudinal fold line 243. In one embodiment, the second side flap 241 includes a first portion 245 that is adjacent the central panel 206, a second portion 247 foldably connected to the first portion at a longitudinal fold line 249, and a third portion 251 foldably connected to the second portion 247 at a longitudinal fold line 253. Each of the first portion 245, second portion 247, and third portion 251 is independently positionable at respective fold lines 243, 249, 253. Alternatively, the second side flap 241 could be similar to the first side flap 237 in that the second flap could be free of fold lines 249, 253 without departing from the disclosure. Alternatively the insert 205 can be otherwise configured, arranged, shaped, and/or disposed without departing from this disclosure.

Figure 3:
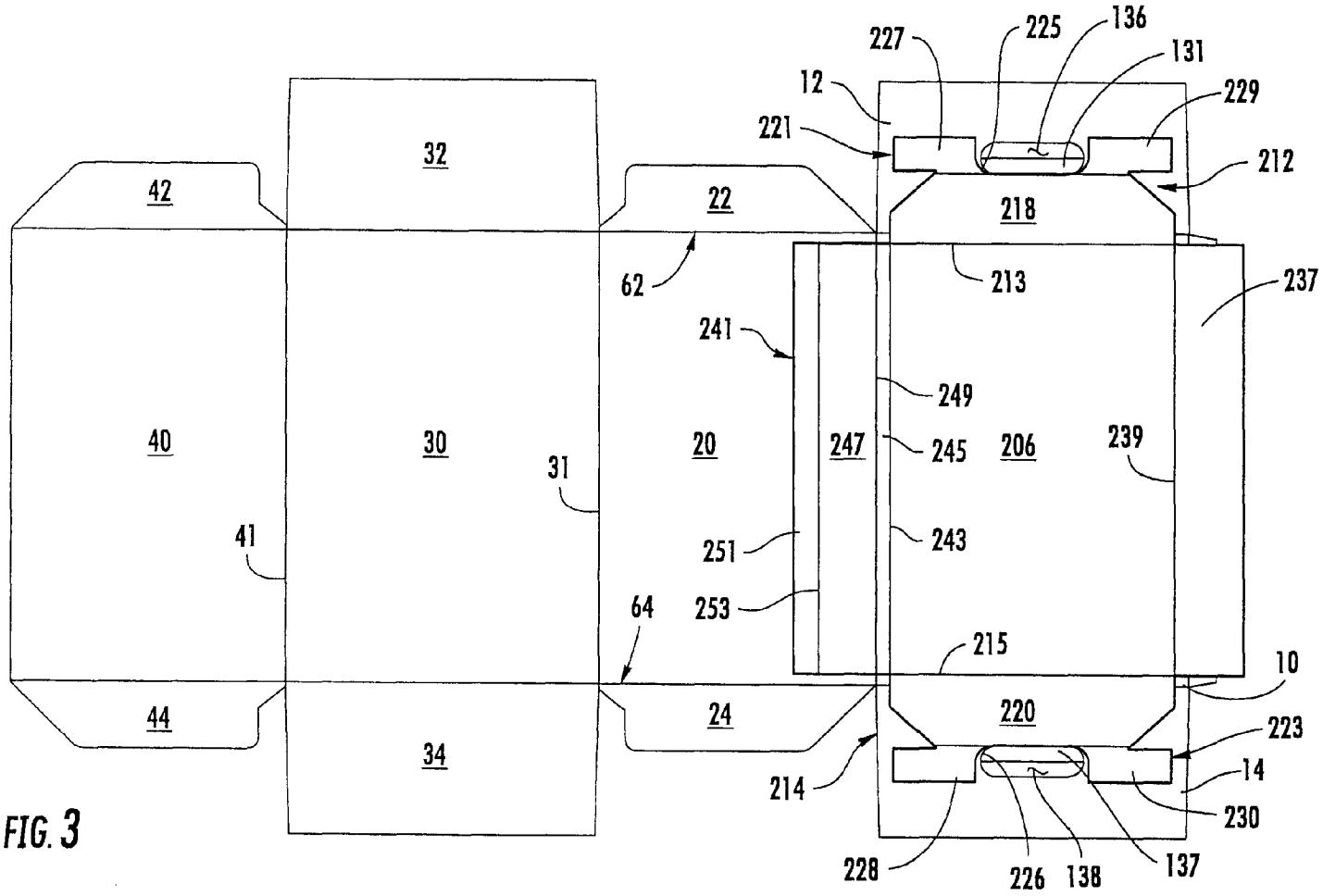
FIG. 3 is a plan view of the insert blank overlaid on a portion of the carton blank according to the exemplary embodiment of the disclosure.

As shown in FIG. 3, the carton 5 may be assembled by initially adhering the insert blank 203 to the top panel 10 of the carton blank 3. The insert blank 203 is positioned on the carton blank 3 so that the central panel 206 is in generally face-to-face contact with the top panel 10. In one embodiment, the interior surface of the insert blank 203 is in contact with the interior surface of the carton blank 3. The insert blank 203 is sized so that the fold lines 213, 215 connecting the reinforcing end flaps 212, 214 are spaced laterally inward from the fold lines 62, 64 connecting the top end flaps 12, 14 to respective ends of the top panel 10. The insert blank 203 is positioned relative to the top panel 10 so that the tabs 227, 229 are adjacent handle flap 131 and the U-shaped notch 225 generally frames the handle flap 131. Similarly, the tabs 228, 230 are adjacent handle flap 137 and the U-shaped notch 226 generally frames the handle flap 137. The central panel 206 of the insert blank 203 can be at least partially adhesively secured to the top panel 10 of the carton blank 3.

In accordance with the exemplary embodiment, the carton blank 3 with insert blank 203 can be further erected into the carton 5 by folding along fold lines 21, 31, 41, and 52 and adhering the attachment flap 50 to the second side panel 40 to form a sleeve. The carton blank 3 may be otherwise configured to have multiple top panels, multiple bottom panels, multiple side panels, or combinations thereof without departing from the scope of this disclosure.

Figure 5:
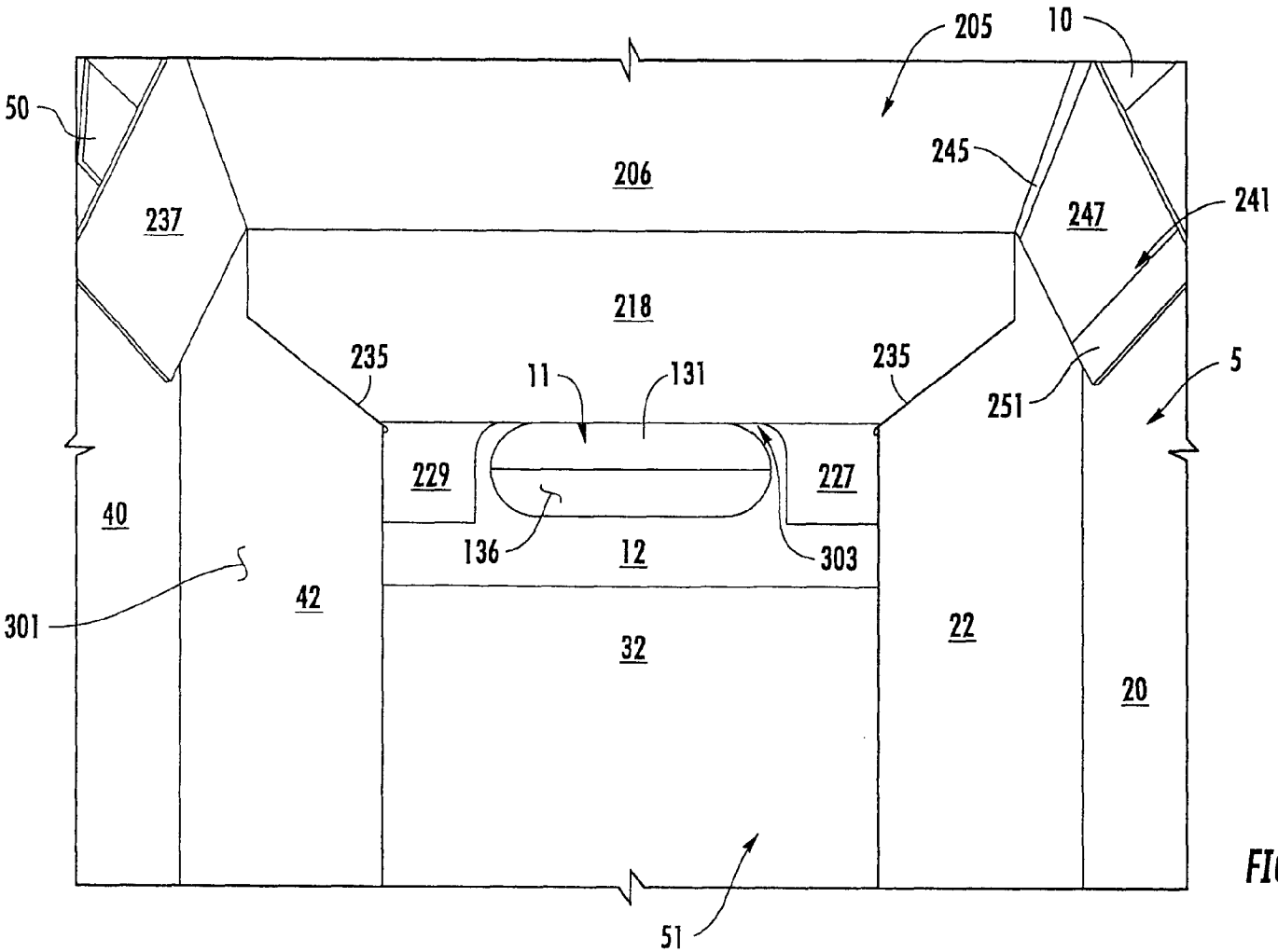
FIG. 5 is an interior view of an end of the carton according to the exemplary embodiment of the disclosure.

In the illustrated embodiment, the first end 51 of the carton 5 is closed by respectively overlapping and adhering the side end flaps 22, 42 and the top and bottom end flaps 12, 32. As shown in FIGS. 4 and 5, the end flaps 12, 22, 32, 42 are closed in a manner so that the tabs 227, 229 of the first reinforcing end flap 212 of the insert blank 203 at least partially overlap a respective side end flap 22, 42. The first reinforcing end flap 212 is downwardly folded as shown in FIG. 4, prior to the downwardly folding of the top end flap 12 to close the first end 51 of the carton 5. Accordingly, portions of the tabs 227, 229 are sandwiched between the top end flap 12 and the respective side end flaps 22, 42. In one embodiment, the tabs 227, 229 are in face-to-face contact with the interior surface of the top end flap 12, and portions of the tabs 227, 229 are in face-to-face contact with the exterior surface of the respective side end flaps 22, 42. The positioning of the tabs 227, 229 can help provide extra reinforcement of the handle 11 and the closed end 51.

The second end 53 of the carton 5 is closed in a similar manner as the first end 51 by respectively overlapping and adhering the side end flaps 24, 44, the top and bottom end flaps 14, 34, and the reinforcing end flap 214 of the insert blank 203. The ends 51, 53 of the carton 5 can be otherwise closed without departing from the disclosure. The containers C can be loaded into the carton 5 before closing either end or after closing the first end 51 or the second end 53.

As shown in FIG. 5, the interior space 301 of the carton 5 is defined by four inwardly tapered surfaces that angle downward from the top panel 10. The tapered surface formed by the base portion 220 of the second reinforcing end flap 214 is not visible in FIG. 5, but it is configured similarly to the base portion 218 of the first reinforcing end flap 212. The four inwardly tapered surfaces contact the top portions of the containers C (e.g., bottles) in the carton 5 to restrain the top portions of the containers and to prevent the containers from movement that can cause the containers to break. The four inwardly tapered surfaces comprise the two base portions 218, 220 of respective reinforcing end flaps 212, 214 and the two side flaps 237, 241 of the insert 205. The base portions 218, 220 extend at an angle from the central panel 206 to the overlapped end flaps forming the closed ends 51, 53, and the two side flaps 237, 241 extend at an angle from the central panel 206 at the top of the carton 5 to the respective side panels 40, 20. The base portions 218, 220 can contact the tops of containers that are adjacent respective ends 51, 53 of the carton, and the side flaps 237, 241 can contact the tops of containers that are adjacent the side panels 40, 20.

Figure 6:
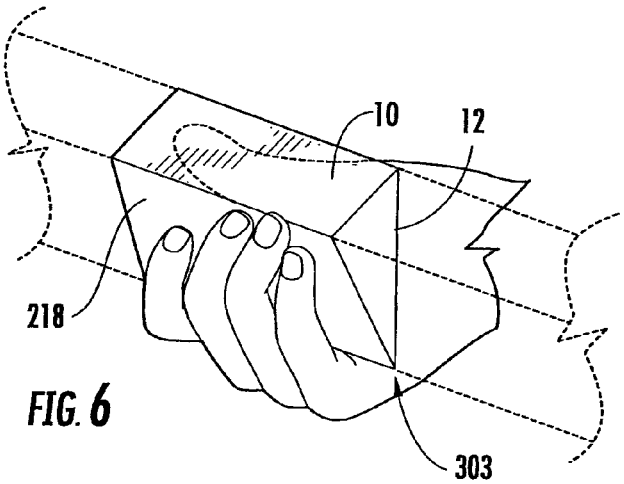
FIG. 6 is a sectional view of a gripping portion of the carton according to the exemplary embodiment of the disclosure.

The handle 11 can be used to grasp the carton 5 by pressing against the elongate handle flap 131 to enlarge the handle opening 136 in the closed first end 51 of the carton 5. Similarly, the handle 111 can be used to grasp the carton 5 at the closed second end 53. In the illustrated embodiment, the base portions 218, 220 can also provide reinforcement features for the handle 11, 111. As shown in FIGS. 5 and 6, the base portion 218 of the first reinforcing end flap 212 can provide an extra layer of material above the handle opening 136 in the top end flap 12. Accordingly, the base portion 218, the top end flap 12, and a portion of the top panel 10 form a reinforcing portion or gripping portion 303 above the handle 11 that has a generally triangular cross-sectional shape. The gripping portion 303 can comprise the inwardly folded handle flap 131 that can be placed in face-to-face contact with base portion 218 of the first reinforcing end flap 212. Similarly, the second end 53 of the carton 5 can include a gripping portion (not shown) above the handle 111 formed by the base portion 220 of the second reinforcing end flap 214, the second top end flap 14, and a portion of the top panel 10.

The carton 5 could have various dispenser features and dispensers that provide access to the containers C in the carton without departing from the disclosure.

Figure 7:
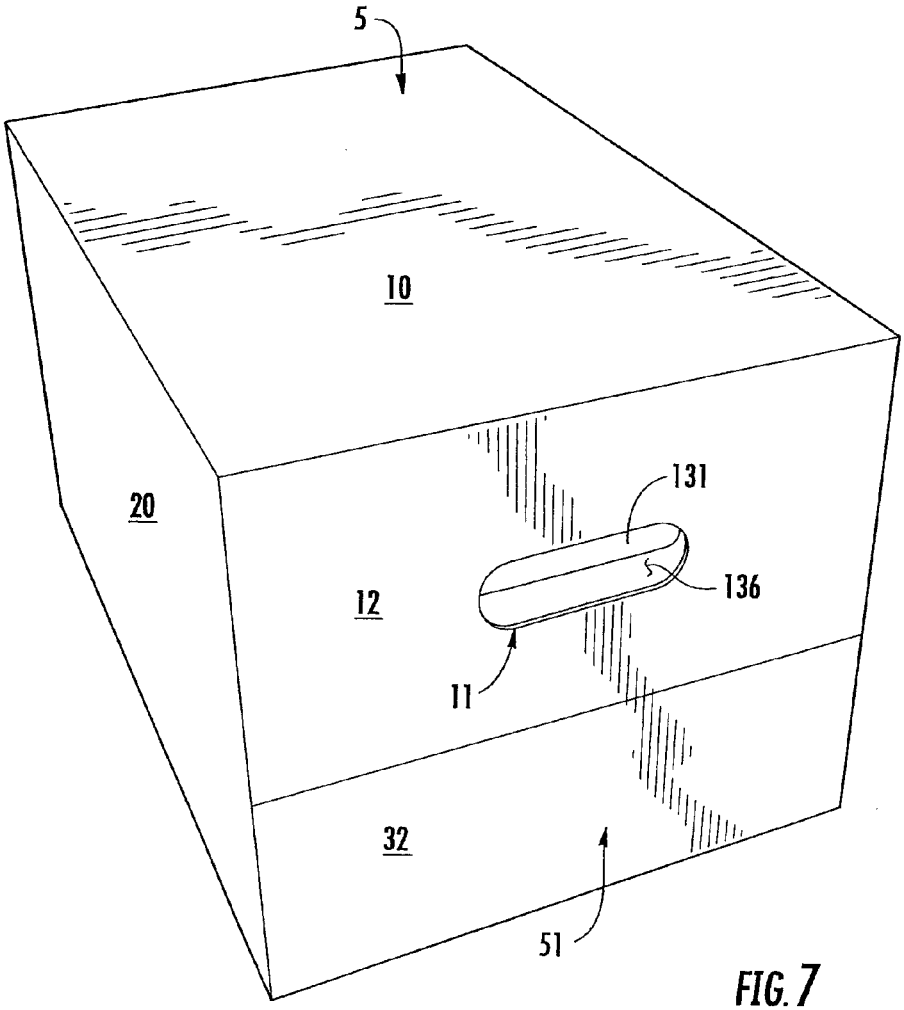
FIG. 7 is a perspective view of the carton according to the exemplary embodiment of the disclosure.

As shown in FIGS. 5 and 7, the side panels 20, 40 of the carton 5 are generally perpendicular to the bottom panel 30 and top panel 10, but the carton could be otherwise shaped without departing from the disclosure. The insert 205 of the carton 5 provides internal bracing of the containers C at the side panels 20, 40 and ends 51, 53.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, the carton comprising:

a plurality of panels that extends at least partially around an interior of the carton, the plurality of panels comprising a top panel, a first side panel, a bottom panel, and a second side panel;

at least two end flaps respectively foldably attached to respective panels of the plurality of panels, the at least two end flaps being for cooperating to at least partially form a closed end of the carton; and a reinforcing insert comprising a central panel and at least one reinforcing end flap, the central panel being at least partially disposed in the interior of the carton, and the at least one reinforcing end flap comprising a base portion and a distal portion foldably connected to the base portion, the base portion extending in an oblique direction from the central panel toward the closed end of the carton.

2. The carton of claim 1, wherein the reinforcing insert further comprises at least one reinforcing side flap foldably connected to the central panel and extending toward at least one of the first side panel and the second side panel in an oblique direction with respect to the top panel.

3. The carton of claim 1, wherein at least a portion of the distal portion being positioned outwardly of at least one end flap of the at least two end flaps.

4. The carton of claim 1, wherein the at least one reinforcing end flap comprises at least one oblique edge extending at least partially between the distal portion of the at least one reinforcing end flap and the central panel.

5. The carton of claim 4, wherein:

the at least one oblique edge of the at least one reinforcing end flap comprises a first oblique edge and a second oblique edge disposed opposite to the first oblique edge.

6. The carton of claim 5, wherein the distal portion comprises at least one tab extending toward at least one of the first side panel and the second side panel.

7. The carton of claim 6, wherein the at least one tab of the distal portion of the at least one reinforcing end flap comprises a first tab and a second tab, the first tab extending toward the first side panel and the second tab extending toward the second side panel.

8. The carton of claim 5, wherein:

the base portion of the at least one reinforcing end flap is foldably connected to the central panel along a first fold line and the distal portion of the at least one reinforcing end flap is foldably connected to the base portion of the at least one reinforcing end flap along a second fold line, the second fold line extending from the first oblique edge of the at least one reinforcing end flap to the second oblique edge of the at least one reinforcing end flap; and the first fold line is longer than the second fold line.

9. The carton of claim 1, wherein:

the at least two end flaps comprises a first side end flap foldably connected to the first side panel, a second side end flap foldably connected to the second side panel, and a top end flap foldably connected to the top panel; and the distal portion of the at least one reinforcing end flap is at least partially in face-to-face contact with an exterior surface of the first side end flap, an exterior surface of the second side end flap, and an interior surface of the top end flap.

10. The carton of claim 9, wherein the top end flap comprises a handle and the distal portion of the at least one reinforcing end flap comprises a notch that is generally aligned with the handle in the top end flap.

11. The carton of claim 8, wherein the notch is at least partially defined by an edge of the base portion of the at least one reinforcing end flap, and the edge of the base portion is disposed proximate an upper edge of the handle of the top end flap.

12. The carton of claim 10, wherein at least a portion of the base portion of the at least one reinforcing end flap and at least a portion of the top end flap form a wedge-shaped gripping portion above the handle in the top end flap and the notch in the distal portion of the at least one reinforcing end flap.

13. The carton of claim 1, wherein the central panel is at least partially in face-to-face contact with the top panel.

14. In combination, a carton blank and an insert blank for forming a carton having container-restraining features for restraining movement of containers in the carton, the carton blank comprising:

a plurality of panels comprising a top panel, a first side panel, a bottom panel, and a second side panel;

at least two end flaps respectively foldably attached to respective panels of the plurality of panels, the at least two end flaps being for cooperating to at least partially close an end of the carton formed from the carton blank and the insert blank; and the insert blank comprising:

a central panel for being at least partially disposed in the interior of the carton formed from the carton blank and the insert blank; and at least one reinforcing end flap comprising a base portion and a distal portion foldably connected to the base portion, the base portion for being positioned to extend in an oblique direction from the central panel toward the closed end of the carton when the carton is formed from the carton blank and the insert blank.

15. The combination of claim 14, wherein the reinforcing insert further comprises at least one reinforcing side flap foldably connected to the central panel, and the reinforcing insert is for being positioned to extend toward at least one of the first side panel and the second side panel in an oblique direction with respect to the top panel when the carton is formed from the carton blank and the insert blank.

16. The combination of claim 1, wherein at least a portion of the distal portion is for being disposed in face-to-face contact with an exterior surface of at least one end flap of the at least two end flaps when the carton is formed from the carton blank and the insert blank.

17. The combination of claim 15, wherein the at least one reinforcing end flap comprises at least one oblique edge extending at least partially between the distal portion of the at least one reinforcing end flap and the central panel.

18. The combination of claim 17, wherein:

the at least one oblique edge of the at least one reinforcing end flap comprises a first oblique edge and a second oblique edge disposed opposite to the first oblique edge.

19. The combination of claim 18, wherein the distal portion comprises at least one tab that is for being positioned to extend toward at least one of the first side panel and the second side panel.

20. The combination of claim 19, wherein the at least one tab of the distal portion of the at least one reinforcing end flap comprises a first tab and a second tab, the first tab extending toward the first side panel and the second tab extending toward the second side panel.

21. The combination of claim 18, wherein:

the base portion of the at least one reinforcing end flap is foldably connected to the central panel along a first fold line and the distal portion of the at least one reinforcing end flap is foldably connected to the base portion of the at least one reinforcing end flap along a second fold line, the second fold line extending from the first oblique edge of the at least one reinforcing end flap to the second oblique edge of the at least one reinforcing end flap; and the first fold line is longer than the second fold line.

22. The combination of claim 14, wherein:

the at least two end flaps comprises a first side end flap foldably connected to the first side panel and a top end flap foldably connected to the top panel; and the distal portion of the at least one reinforcing end flap is for being disposed at least partially in face-to-face contact with an exterior surface of the first side end flap and an interior surface of the top end flap when the carton is formed from the carton blank and the insert blank.

23. The combination of claim 22, wherein:

the at least two end flaps comprises a second side end flap foldably connected to the second side panel; and the distal portion of the at least one reinforcing end flap is for being disposed at least partially in face-to-face contact with an exterior surface of the second side end flap when the carton is formed from the carton blank and the insert blank.

24. The combination of claim 23, wherein the top end flap comprises a handle and the distal portion of the at least one reinforcing end flap comprises a notch that is for being generally aligned with the handle in the top end flap when the carton is formed from the carton blank and the insert blank.

25. The combination of claim 24, wherein the notch is at least partially defined by an edge of the base portion of the at least one reinforcing end flap, and the edge of the base portion is for being disposed proximate an upper edge of the handle of the top end flap when the carton is formed from the carton blank and the insert blank.

26. The combination of claim 14, wherein:

the at least one reinforcing end flap comprises a first reinforcing end flap and an opposing second reinforcing end flap, each of the first reinforcing end flap and the second reinforcing end flap being foldably connected to the central panel; and the reinforcing insert further comprises a first reinforcing side flap and an opposing second reinforcing side flap, each the first reinforcing side flap and the second reinforcing side flap being foldably connected to the central panel.

27. A method of forming a carton, comprising:

obtaining a carton blank comprising a plurality of panels comprising a top panel, a first side panel, a bottom panel, and a second side panel, and at least two end flaps respectively foldably attached to respective panels of the plurality of panels;

obtaining a reinforcing insert comprising a central panel and at least one reinforcing end flap, the at least one reinforcing end flap comprising a base portion and a distal portion foldably connected to the base portion;

positioning the reinforcing insert relative to the carton blank and forming an interior of the carton at least partially defined by the plurality of panels with the central panel disposed at least partially within the interior of the carton, the forming the interior of the carton comprising forming an open-ended sleeve;

positioning the base portion of the at least one reinforcing end flap to extend in an oblique direction from the central panel toward an end of the open-ended sleeve; and positioning the at least two end flaps and the distal portion of the at least one reinforcing end flap to at least partially close an end of the open-ended sleeve.

28. The method of claim 27, wherein:

the reinforcing insert further comprises at least one reinforcing side flap foldably connected to the central panel; and the method further comprising positioning the at least one reinforcing side flap to extend toward at least one of the first side panel and the second side panel in an oblique direction with respect to the top panel.

29. The method of claim 27, wherein:

the at least two end flaps comprises a first side end flap foldably connected to the first side panel and a top end flap foldably connected to the top panel; and the positioning the at least two end flaps and the distal portion of the at least one reinforcing end flap comprises positioning the distal portion of the at least one reinforcing end flap at least partially in face-to-face contact with an exterior surface of the first side end flap and an interior surface of the top end flap.

30. The method of claim 27, wherein:

the top end flap comprises a handle and the distal portion of the at least one reinforcing end flap comprises a notch; and the positioning the at least two end flaps and the distal portion of the at least one reinforcing end flap comprises generally aligning the notch of the distal portion of the at least one reinforcing end flap with the handle in the top end flap.

31. The method of claim 30, wherein the positioning the at least two end flaps and the distal portion of the at least one reinforcing end flap comprises forming a wedge-shaped gripping portion above the handle in the top end flap and the notch in the distal portion of the at least one reinforcing end flap, the gripping portion comprising at least a portion of the base portion of the at least one reinforcing end flap and at least a portion of the top end flap.

32. The method of claim 27, wherein:

the forming the interior of the carton comprises positioning at least one of the first side panel and the second side panel to be generally perpendicular to the top panel; and the positioning the at least two end flaps and the distal portion of the at least one reinforcing end flap comprises positioning the at least two end flaps to be generally perpendicular to the top panel.

33. The method of claim 27, wherein the distal portion comprises at least one tab, the positioning the at least two end flaps and the distal portion comprises positioning at least a portion of the distal portion outwardly of at least one end flap of the at least two end flaps, and the at least one tab of the distal portion extends toward at least one of the first side panel and the second side panel.

* * * * *